US012221887B2

(12) United States Patent
Wang et al.

(10) Patent No.: US 12,221,887 B2
(45) Date of Patent: Feb. 11, 2025

(54) SURROUNDING ROCK STABILITY CONTROL METHOD ADAPTED FOR COAL MINING AREA MAIN ROADWAY

(71) Applicant: China University of Mining and Technology, Beijing, Beijing (CN)

(72) Inventors: Jiong Wang, Beijing (CN); Guangyuan Yu, Beijing (CN); Jian Jiang, Beijing (CN)

(73) Assignee: CHINA UNIVERSITY OF MINING AND TECHNOLOGY, Beijing (CN)

( * ) Notice: Subject to any disclaimer, the term of this patent is extended or adjusted under 35 U.S.C. 154(b) by 381 days.

(21) Appl. No.: 17/605,771

(22) PCT Filed: Apr. 15, 2020

(86) PCT No.: PCT/CN2020/084944
§ 371 (c)(1),
(2) Date: Sep. 9, 2022

(87) PCT Pub. No.: WO2020/216114
PCT Pub. Date: Oct. 29, 2020

(65) Prior Publication Data

US 2023/0063143 A1 Mar. 2, 2023

(30) Foreign Application Priority Data

Apr. 23, 2019 (CN) ..... 201910330047.7

(51) Int. Cl.
*E21C 41/18* (2006.01)
*E21D 9/14* (2006.01)

(52) U.S. Cl.
CPC ..... *E21C 41/18* (2013.01); *E21D 9/14* (2013.01)

(58) Field of Classification Search
CPC ..... E21C 41/18; E21D 9/14
See application file for complete search history.

(56) References Cited

U.S. PATENT DOCUMENTS 11,008,860 B2 * 5/2021 He ..... E21C 41/16

FOREIGN PATENT DOCUMENTS

CN 103244180 A 8/2013
CN 103967522 A 8/2014
(Continued)

OTHER PUBLICATIONS

International Search Report regarding PCT/CN2020/084944, Jun. 30, 2020, China National Intellectual Property Administration.

*Primary Examiner* — Janine M Kreck
(74) *Attorney, Agent, or Firm* — Sisson & Banyas, Attorneys at law, LLC; Jeffrey J. Banyas

(57) ABSTRACT

The present disclosure relates to a technical field of coal mining, in particular to a surrounding rock stability control method adapted for a coal mining area main roadway. The method comprises the following steps: reinforcing support on a roof and two sides of the mining area main roadway on a basis of an original support form; digging a safety roadway along a stop line of a present working face required by coal mine design, and supporting the safety roadway, wherein a protective coal pillar is formed between the safety roadway and the mining area main roadway; performing slitting blasting on the roof in the safety roadway, wherein blast holes are arranged on a roadway corner line on one side of the present working face to form a pre-splitting slit; and performing stoping at a next working face after completing coal mining at the present working face when stoping at the present working face advances to the safety roadway. By cutting the roof and relieving pressure at the stop mining line of the working face, an influence of mining disturbance on stability of the mining area main roadway in the stoping process of the working face is reduced, and by reinforcing support, a yielding deformation capacity of the mining area main roadway is improved, and the stability of the surround- (Continued)

ing rock of the mining area main roadway is further improved.

7 Claims, 6 Drawing Sheets

(56) References Cited

FOREIGN PATENT DOCUMENTS

| | | | |
|---|---|---|---|
| CN | 104763425 | A | 7/2015 |
| CN | 106437711 | A | 2/2017 |
| CN | 106437712 | A | 2/2017 |
| CN | 107956475 | A | 4/2018 |
| CN | 110145326 | A | 8/2019 |
| RU | 2284414 | C1 | 9/2006 |

* cited by examiner

SURROUNDING ROCK STABILITY CONTROL METHOD ADAPTED FOR COAL MINING AREA MAIN ROADWAY

PRIORITIES AND CROSS REFERENCES

This Application claims priority from International Application No. PCT/CN2020/084944 filed on 15 Apr. 2020, and Chinese Patent Application No. 201910330047.7 filed on 23 Apr. 2019 the teachings of each of which are incorporated by reference herein in their entirety.

FIELD

The present disclosure relates to a technical field of coal mining, in particular to a surrounding rock stability control method adapted for a coal mining area main roadway.

BACKGROUND

A long-wall mining method is widely used in coal mining of China. In the process of mining, pressure in advance of a working face will be generated along an advancing direction of the working face, which is called advanced abutment pressure. With the advance of the working face, the advanced abutment pressure also moves forward. When the working face advances to the vicinity of a mining area main roadway, the advanced pressure acts on the mining area main roadway, which will easily lead to deformation and damage on the main roadway. Moreover, in the process of advance and retreat of the working face, dynamic pressure disturbance will occur in a certain range near the working face due to stress concentration and release, which will adversely affect stability control of the mining area main roadway. In addition, stoping and retreat of the present working face and adjacent working faces thereof will cause certain dynamic pressure disturbance to the main roadway, thereby leading to deformation of the main roadway, which is difficult to maintain. In order to resist the disturbance of dynamic pressure on the main roadway, technologies such as an anchor cable, a grouting anchor bolt, and a scaffold are used to reinforce the main roadway. Although certain effects have been achieved, these reinforcement measures are all characterized by high-strength support, and dynamic pressure and a support structure confront each other, resulting in stress concentration and damage of the main roadway. The main roadway does not have large deformation characteristics, has low dynamic pressure resistance, and is easily deformed and damaged under plural times of disturbance on a plurality of working faces.

SUMMARY

In order to solve the above technical issues, the present disclosure provides the following technical solution.

The present disclosure provides a surrounding rock stability control method adapted for a coal mining area main roadway, which comprises the following steps:

reinforcing support on a roof and two sides of the mining area main roadway on a basis of an original support form;

digging a safety roadway along a stop mining line of a present working face required by the coal mine design, and supporting the safety roadway, wherein a protective coal pillar is formed between the safety roadway and the mining area main roadway;

performing slitting blasting on the roof in the safety roadway, wherein blast holes are arranged on a roadway corner line on one side of the present working face to form a pre-splitting slit, and a latest time of completing construction of the pre-splitting slit is when the length of the present working face to be stopped is equal to a width of the protective coal pillar; and performing stoping at a next working face after completing coal mining at the present working face when stoping at the present working face advances to the safety roadway.

Further, one end of the pre-splitting slit extends to a roadway corner line of a first gateway near a previous working face, another end of the pre-splitting slit extends to a roadway corner line of a second gateway near the next working face, and both ends of the pre-splitting slit extend along the roadway corner lines of the two gateways to a direction away from the safety roadway.

Further, the length of the pre-splitting slit extends along the roadway corner line of the first gateway or the second gateway is 10 m to 15 m.

Further, in a step of reinforcing support on the roof and two sides of the mining area main roadway, both a constant resistance anchor cable and a grouting anchor cable are used for reinforcing support on the roof, and only the grouting anchor cable is used for reinforcing support on the two sides.

Further, in a step of performing slitting blasting on the roof in the safety roadway, the blast hole is designed to be 8000 mm to 1000 mm in depth and 42 mm in diameter, leans to the working face, and has an angle of 10° to 20° with a plumb line, and spacing between slit holes is 400 mm to 700 mm.

Further, in the step of performing slitting blasting on the roof in the safety roadway, a bidirectional tensile shaped charge device is used for shaped charge blasting, a shaped charge blasting tube is used for loading 3 #emulsion explosive, and decoupling deck charging is used for blasting to form the pre-splitting slit.

Compared with the prior art, the technical solution provided by examples of the present disclosure has the following advantages: by cutting the roof and relieving pressure at the stop mining line of the working face, an influence of mining disturbance on stability of the mining area main roadway in the stoping process of the working face is reduced, and by reinforcing support, a yielding deformation capacity of the mining area main roadway is improved, and the stability of the surrounding rock of the mining area main roadway is further improved.

BRIEF DESCRIPTION OF THE DRAWINGS

The drawings herein are incorporated into the specification and constitute a part of the specification. The drawings show examples conforming to the present disclosure and are used together with the specification to explain the principle of the present disclosure.

In order to explain the technical solutions more clearly in the examples of the present disclosure or the prior art, the drawings used in the examples or the description of the prior art are briefly explained. Obviously, one skilled in the art can obtain other drawings based on these drawings without involving creative efforts.

In the drawings.

Figure 1:
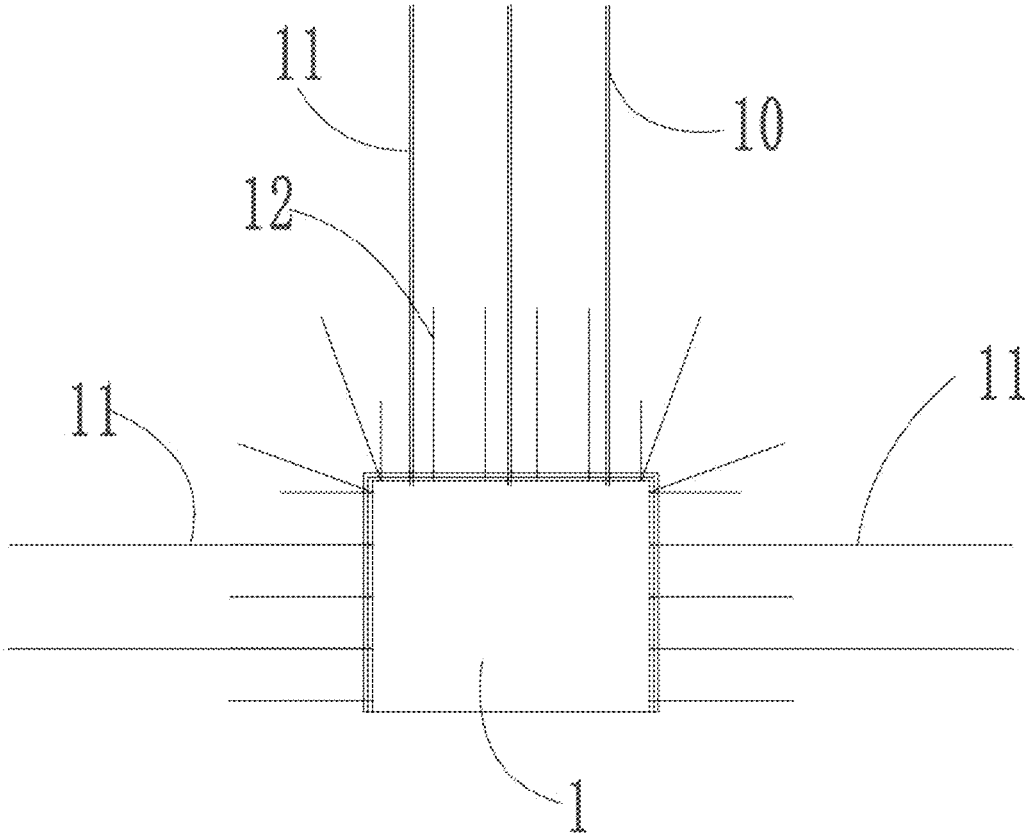
FIG. 1 is a schematic diagram of a cross section of a reinforcing support design of a mining area main roadway in an example of the present disclosure.

1. mining area main roadway; 2. present working face; 3. previous working face; 4. next working face; 5. first gateway; 6. second gateway; 7. safety roadway; 8. protective coal pillar; 9. blast hole; 10. constant resistance and large deformation anchor cable; 11. grouting anchor cable; 12. common anchor bolt.

DETAILED DESCRIPTION

In order let one skilled in the art better understand the solution of the present disclosure, some examples of the technical solutions of the present disclosure will be described clearly and completely with reference to the drawings of the examples in the present disclosure. It is obvious that the examples as described are only some of the examples of the present disclosure, rather than all the examples. Based on the examples in the present disclosure, all other examples obtained by one skilled in the art without involving inventive effort fall within the protection scope of the present disclosure.

It should be noted that the specification and claims of the present disclosure and the terms "first", "second", and the like in the drawings are used to distinguish similar objects and are not necessarily used to describe a particular order or sequential order. It is to be understood that the data so used are interchangeable under appropriate circumstances for the examples of the present disclosure described herein. Further, the terms "comprise", "have", and any variations thereof are intended to cover a non-exclusive inclusion, such as that a process, method, system, product, or apparatus that comprises a series of steps or elements is not necessarily limited to those steps or elements explicitly listed, but may comprise other steps or elements not explicitly listed or inherent to the process, method, product, or apparatus.

In the present disclosure, the orientational or positional relationships indicated by the terms "on", "under", "in", "within", "out", "front", "behind", and the like are based on the orientational or positional relationships shown in the drawings. These terms are used primarily to better describe the present disclosure and examples thereof, and are not used to limit that the indicated device, element, or component must have a particular orientation or be configured and operated in a particular orientation.

In addition, part of the above terms may be used to represent other meanings in addition to the orientational or positional relationship, for example, the term "on" may also be used to represent a certain attachment relationship or connection relationship in some circumstances. Specific meanings of these terms in the present disclosure may be understood by one skilled in the art in light of specific circumstances.

Further, the terms "dispose", "connect", and "fix" are to be understood broadly. For example, "connect" may be fixed connection, detachable connection, or integral construction; may be mechanical connection, or electric connection; may be direct connection or indirect connection by an intermediate medium, or may be internal connection between two devices, elements or components. Specific meanings of the above terms in the present disclosure may be understood by one skilled in the art in light of specific circumstances.

It should be noted that the examples and features in the examples of the present disclosure may be combined with each other in the case of no conflict. The present disclosure will be described in detail below with reference to FIG. 1 to FIG. 8 and in combination with the examples.

The example of the present disclosure provides a surrounding rock stability control method adapted for a coal mining area main roadway, which comprises the following steps:

Step 1: reinforcing support on a roof and two sides of a mining area main roadway 1 on a basis of an original support form;

Step 2: digging a safety roadway 7 along a stop mining line of a present working face 2 required by the coal mine design, and supporting the safety roadway 7, wherein a protective coal pillar 8 is formed between the safety roadway 7 and the mining area main roadway 1;

Step 3: performing slitting blasting on the roof in the safety roadway 7, wherein blast holes 9 are arranged on a roadway corner line on one side of the present working face 2 to form a pre-splitting slit, and a latest time of completing construction of the pre-splitting slit is when a length of the present working face 1 to be stopped is equal to a width of the protective coal pillar 8; and Step 4: performing stoping at a next working face 4 after completing coal mining at the present working face 2 when stoping at the present working face 2 advances to the safety roadway 7.

The surrounding rock stability control method provided by the example of the present disclosure mainly adopts roof cutting and pressure relief at the stop mining line in cooperation with reinforcing support in the mining area main roadway to control deformation of the surrounding rock, and has the following technical advantages: the influence of abutment pressure and mining disturbance on the mining area main roadway is reduced. Through roof-cutting blasting at the stop mining line, the surrounding rock structure is changed, and roof-cut short wall beams are formed, which cuts off connection between a roof of the working face and a roof of the protective coal pillar, thereby reducing the influence of the abutment pressure and mining disturbance on stability of the protective coal pillar and main roadway. As the design process of the width of the protective coal pillar has considered avoiding disturbance of the stoping dynamic pressure on the main roadway, in order to avoid action of the stoping dynamic pressure on the safety roadway and to prevent workers from slitting in a dynamic pressure influence range, and referring to the width of the protective coal pillar, the slit construction should be completed before the length of the working face to be stopped is equal to the width of the protective coal pillar, which can effectively ensure construction safety and can further ensure transfer of the stoping dynamic pressure to the protective coal pillar and the mining area main roadway. It should be noted that the width of the protective coal pillar mentioned in the present disclosure should be understood as the shortest distance between the stop mining line of the working face and the mining area main roadway. When the mining area main roadway is perpendicular to a stoping direction of the working face, the mining area main roadway is parallel to the stop mining line, the protective coal pillar has a rectangular structure, and the length of the protective coal pillar is the distance between the mining area main roadway and the stop mining line; when the mining area main roadway is not perpendicular to the mining direction of the working face, the width of the protective coal pillar is the shorter one of the distances between the stop mining line of the working face and the mining area main roadway at the two gateways. For example, in the working face structure shown in FIG. 3, the width of the protective coal pillar is the distance between the stop mining line and the mining area main roadway at a first gateway 5.

Figure 2:
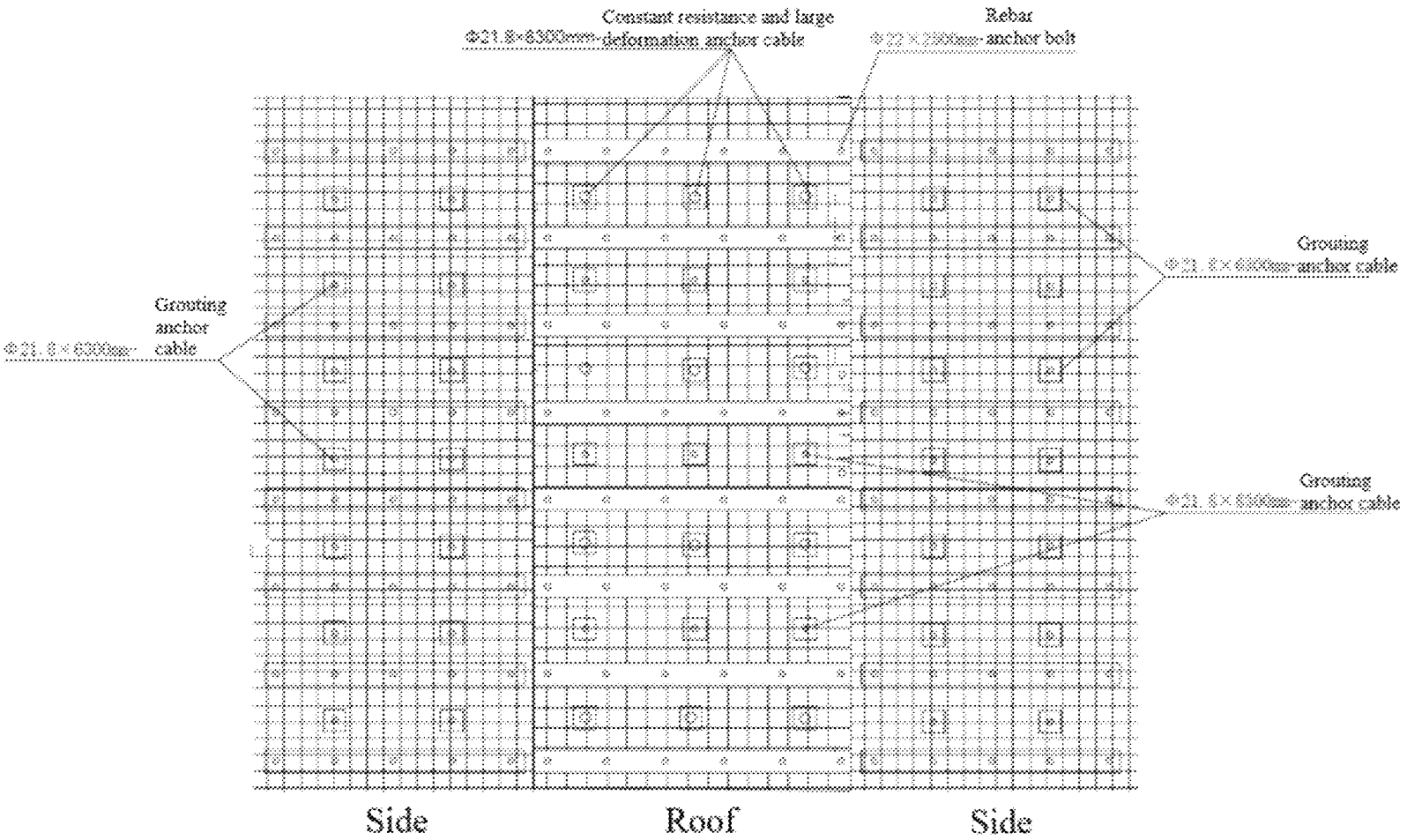
FIG. 2 is an expanded schematic diagram of a reinforcing support design of a mining area main roadway in an example of the present disclosure.

Specifically, in some examples, in step 1, a constant resistance support structure is used to reinforce support on the roof of the mining area main roadway 1, and a roadway side support structure is used to reinforce support on the two sides of the mining area main roadway 1. As shown in FIG. 1 and FIG. 2, an optional reinforcing support method is given. The constant resistance support structure of the roof of the mining area main roadway includes a steel bar mesh, a common anchor bolt 12, a W steel strip, a grouting anchor cable 11, and a high-prestress constant resistance and large deformation anchor cable 10, wherein the steel bar mesh adheres to the roof of the mining area main roadway 1, the W steel strip is disposed outside the steel bar mesh, and the common anchor bolt 12 is anchored to the roof by an end of the W steel strip, and an interval of the common anchor bolts 12 is 900 mm×1000 mm; the constant resistance and large deformation anchor cable 10 and the grouting anchor cable 11 are equally divided into three rows and arranged on the roof of the mining area main roadway 1, and the anchor cables are arranged perpendicular to the roadway roof. The first row is 600 mm away from one roadway side, the second row is arranged along the middle line of the mining area main roadway 1, and the third row is 600 mm away from the other roadway side, and row spacing of the anchor cables is 2000 mm. The common anchor bolt 12 can be a rebar anchor bolt of φ22 mm×2500 mm, specifications of the constant resistance and large deformation anchor cable 10 can be φ21.8 mm×8300 mm, and specifications of the grouting anchor cable 11 for supporting the roof can be φ21.8 mm×8300 mm; the roadway side support structure includes a steel bar mesh, a common anchor bolt, a W steel strip, and a grouting anchor cable 11, in which the steel bar mesh adheres to the roadway wall, the W steel strip is arranged outside the steel bar mesh, the common anchor bolt is fixed by the end of the W steel strip, the interval of the common anchor bolts is 900 mm×1000 mm, the interval of the grouting anchor cables 11 is 1800 mm×1000 mm, and the direction of the anchor cable is perpendicular to the side, and specifications of the grouting anchor cable 11 for supporting the two sides can be φ21.8 mm×6300 mm.

In the prior art, on one hand, support structures (such as a common anchor bolt, a common anchor cable, and a scaffold) of the mining area main roadway are all small deformation support materials, cannot produce large elongation deformation while ensuring support strength, and thus energy cannot be released in time under disturbance of the stoping dynamic pressure of the working face, thereby causing local stress concentration and leading to a roadway damage support structure, that is, rigidity is sufficient and deformation is insufficient; on the other hand, a prestress applied to the support structure is insufficient: since deformation of the common anchor bolt and anchor cable is small, if the applied prestress is too high and a part of the deformation of the anchor bolt (cable) is consumed, the anchor bolt (cable) is easily snapped when the surrounding rock is deformed. Therefore, a large prestress cannot be applied during use, and the active support effect is weakened.

On one hand, the reinforcing support structure of the above example of the present disclosure can improve yielding deformation capacity of the surrounding rock of the mining area main roadway 1. When the roadway surrounding rock is greatly deformed, when the pressure of the surrounding rock on the constant resistance and large deformation anchor cable 10 reaches the constant resistance value of the constant resistance and large deformation anchor cable 10, a constant resistor of the constant resistance and large deformation anchor cable 10 starts to generate sliding deformation while keeping the support resistance constant and absorbs energy, which yields the pressure of the surrounding rock properly to reduce the pressure of the surrounding rock; finally, when the pressure is reduced to less than the constant resistance value, the constant resistor stops stretching deformation, prevents a loose zone and a plastic zone of the surrounding rock from developing into the rock mass, and avoids damage of key parts of the mining area main roadway 1, thereby achieving the object of controlling the stability of the surrounding rock of the mining area main roadway 1.

On the other hand, the reinforcing support structure of the above example of the present disclosure can improve strength of the surrounding rock of the mining area main roadway 1. Support with the high-prestress constant resistance and large deformation anchor cable 10 first can give a large prestress to the surrounding rock, change two-direction stress to three-direction stress, improve the stress state of the surrounding rock, and improve the overall strength of the surrounding rock; secondly, in the stoping process of the working face, the grouting anchor cable 11 can be used to grout the roof and sides of the mining area main roadway with cracks, so as to improve the strength of the surrounding rock of the roof and sides. Through repeated grouting of the grouting anchor cables 11, the strength of the damaged rock mass can be restored in time, thereby improving integrity of the surrounding rock and strengthening its stability.

Figure 3:
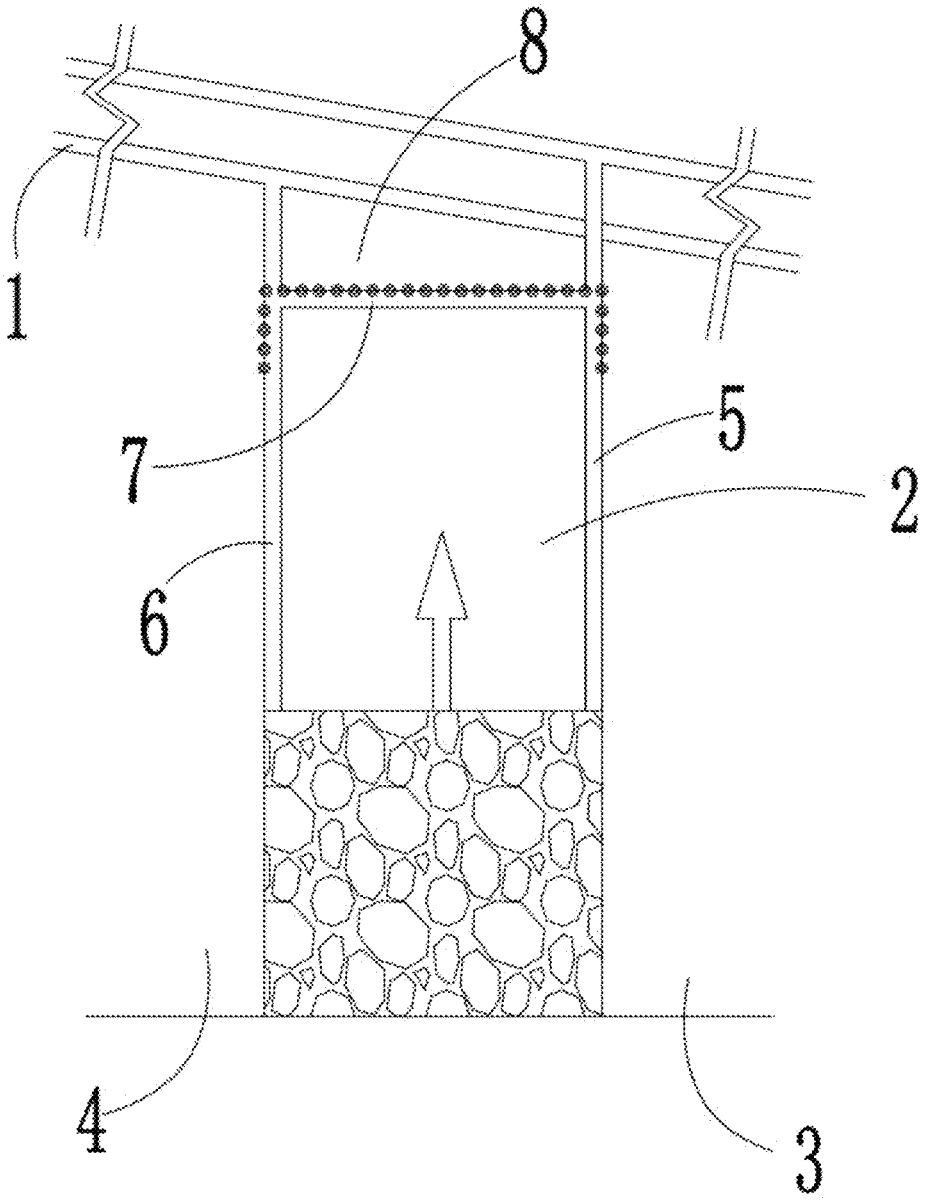
FIG. 3 is a schematic diagram of layout of a coal mining working face in an example of the present disclosure.

Specifically, in step 2, the purpose of excavating the safety roadway 7 is to prepare for performing slitting blasting in step 3. As shown in FIG. 3, excavation timing of the safety roadway 7 is before the end of stoping of the working face 2, which is excavating a roadway in substance coal. Two ends of the safety roadway 7 are respectively connected with the first gateway 5 and the second gateway 6 on both sides of the working face 2.

Figure 4:
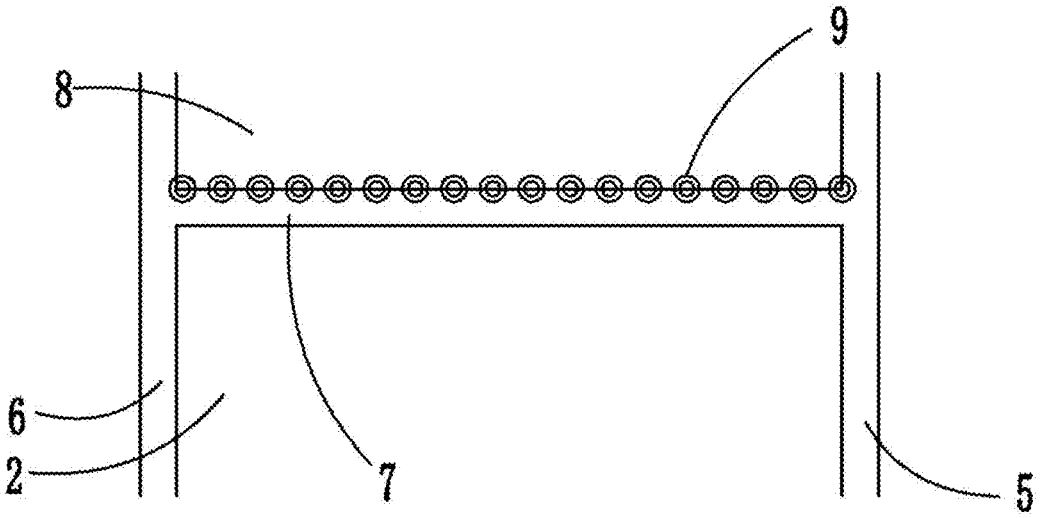
FIG. 4 is a schematic diagram of a layout mode of roof-cutting blast holes in the present disclosure.
Figure 6:
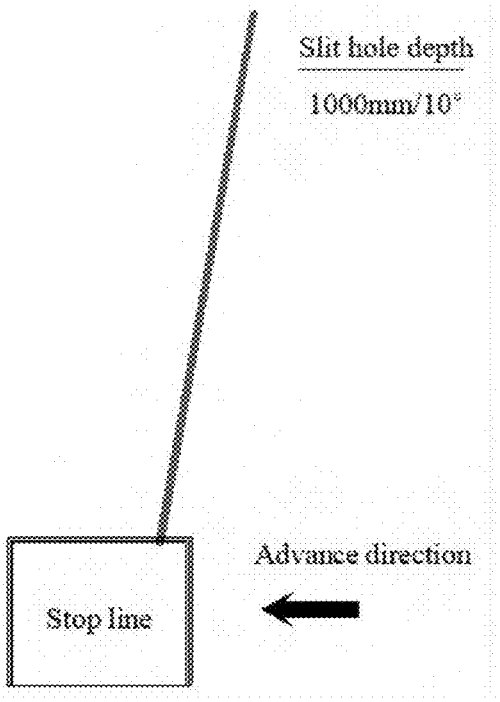
FIG. 6 is a schematic diagram of design of length and angle of roof-cutting blast holes.
Figure 7:
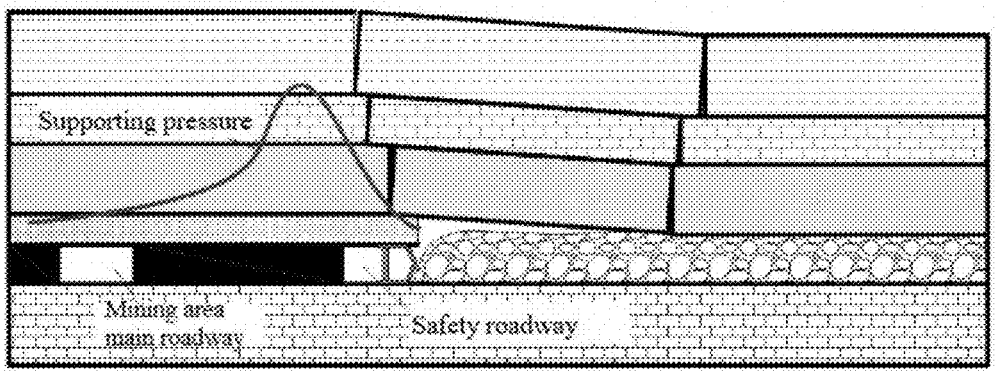
FIG. 7 is a schematic diagram of a surrounding rock structure and an abutment pressure variation before roof cutting.
Figure 8:
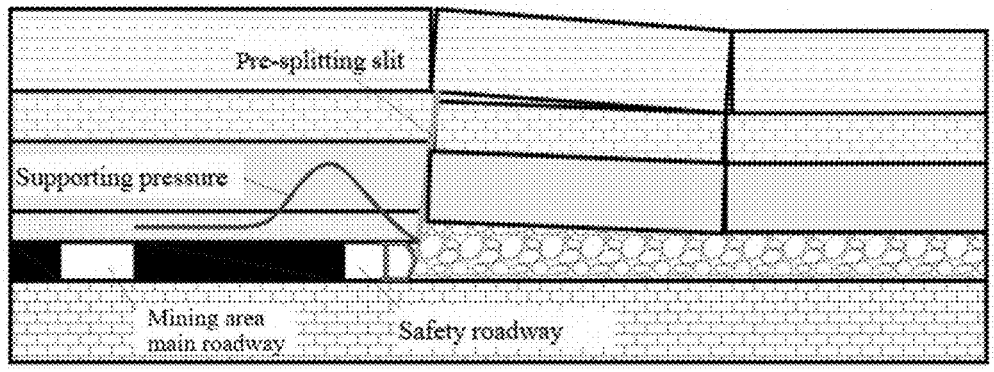
FIG. 8 is a schematic diagram of a surrounding rock structure and an abutment pressure variation after roof cutting.

Specifically, in some examples, in the step of performing slitting blasting on the roof in the safety roadway 7, the blast hole 9 is designed to be 8000 mm to 1000 mm in depth and 42 mm in diameter, leans to the working face 2 and has an angle of 10° to 20° with the plumb line, and has spacing of 400 mm to 700 mm. The specific parameters can be adjusted according to site terrane conditions and effects. As shown in FIG. 4 and FIG. 6, an optional slitting blasting method is given. The slit hole, namely the blast hole 9, is designed to be 1000 mm in depth and 42 mm in diameter, leans to the working face, has an angle of 10° with the plumb line, and has spacing of 500 mm. The shaped charge blasting tube is used to charge 3 #emulsion explosive and the decoupling deck charging is used for blasting, which can cut off connection between the basic roof of the present working face and the roof of the coal pillar. FIG. 7 and FIG. 8 show schematic diagrams of a surrounding rock structure and an abutment pressure variation respectively before and after roof cutting. It can be seen by comparison between the two drawings that stress transfer can be significantly reduced and abutment pressure of the surrounding rock structure can be reduced by the roof cutting and pressure relief in the above example.

In the present blasting roof-breaking and pressure-relief technologies, a roof is cut off by a deep-hole blasting technology, which has certain shortcomings and deficiencies. On one hand, the deep-hole blasting is easy to damage the protective coal pillar. The deep-hole blasting cannot control the propagation direction of explosion energy, and blast shock, shock wave, and explosive gas randomly propagate around during blasting, which damages the pillar and surrounding rock, and adversely affects the stability of the main roadway. On the other hand, deep-hole blasting has large unit consumption and high costs of pressure relief explosive, which leads to rapid energy dissipation due to random propagation of explosion energy around. Therefore, in order to ensure the effect of roof breakage, it is necessary to increase the density of blast holes and the amount of explosive, which leads to growth of roof cutting costs.

The above technical solution of the example can reduce the damage of blasting to the coal pillar and surrounding rock. This example adopts a shaped charge directional roof cutting and pressure relief technology, specifically, shaped charge blasting is carried out by using a bidirectional tensile shaped charge device, so as to cut off the roof and realize the object of roof cutting and pressure relief at the stop mining line; by using the bidirectional shaped charge blasting device, the propagation direction of explosion energy can be controlled. Shaped charge flows are generated in two set directions after blasting, and concentrated tensile stress is generated, and a slit is formed by the compressive and non-tensile characteristics of rock, thereby minimizing the damage of blasting to the surrounding rock. Moreover, the unit consumption of explosive is small and the costs are low.

After the reinforcing support and roof cutting are finished, mining pressure will act on the mining area main roadway in the stoping process of the working face. When the mining pressure exceeds the support strength of the main roadway, the constant resistance anchor cable starts to retract and deform to realize a yielding function. After disturbance is over, the grouting anchor cable can be used to grout crack parts of the roof, thus restoring the strength of the roof rock mass. Thus, dual purposes of releasing pressure and strengthening the roof can be realized by repeatedly yielding and grouting. Meanwhile, for a side deformation area, the side stability can be improved by grouting reinforcement with side grouting anchor cables, and thus the mining area main roadway can withstand plural times of dynamic pressure disturbance and still keeps stable.

Figure 5:
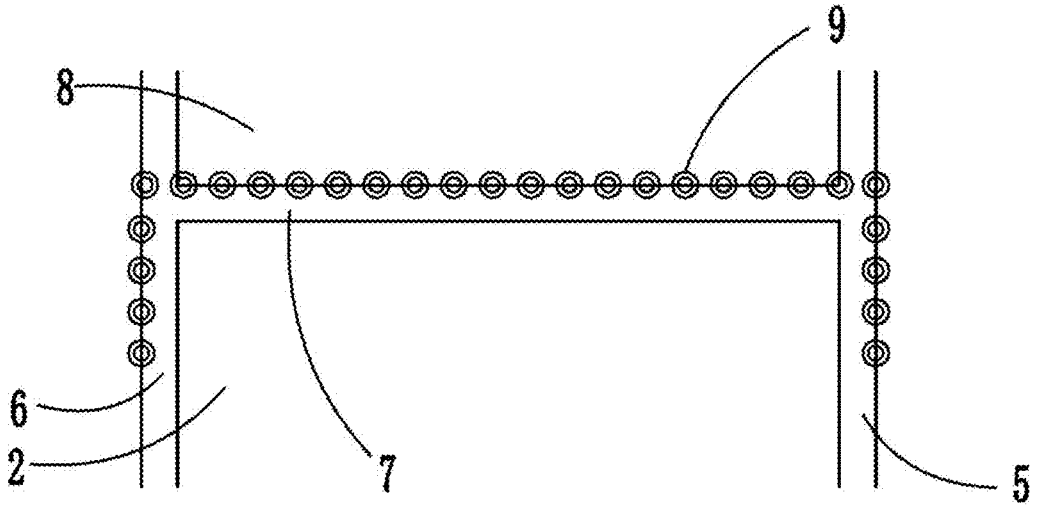
FIG. 5 is a schematic diagram of another layout mode of roof-cutting blast holes in the present disclosure.

With the stoping of the working face, abutment pressure and mining pressure will be produced both in front of and in an inclined direction of the working face, in which the front abutment pressure and mining pressure act on the coal in front of the working face, while the abutment pressure and mining pressure in the inclined direction act on the coal in the adjacent working face. However, when there is a certain angle between the supported main roadway and the working face, as the working face gets closer and closer to the main roadway, the abutment pressure and mining pressure in the inclined direction will also act on the main roadway. In some examples, as shown in FIG. 5, one end of the pre-splitting slit extends to the roadway corner line of the first gateway 5 near the previous working face 3, the other end of the pre-splitting slit extends to the roadway corner line of the second gateway 6 near the next working face 4, and both ends of the pre-splitting slit extend along the roadway corner lines of the two gateways respectively in the direction away from the protective coal pillar 8. This solution can effectively avoid the abutment pressure in the inclined direction from acting on the main roadway. Besides, extension of the slit to both ends is beneficial to full collapse of the roof in the goaf.

Figure 9:
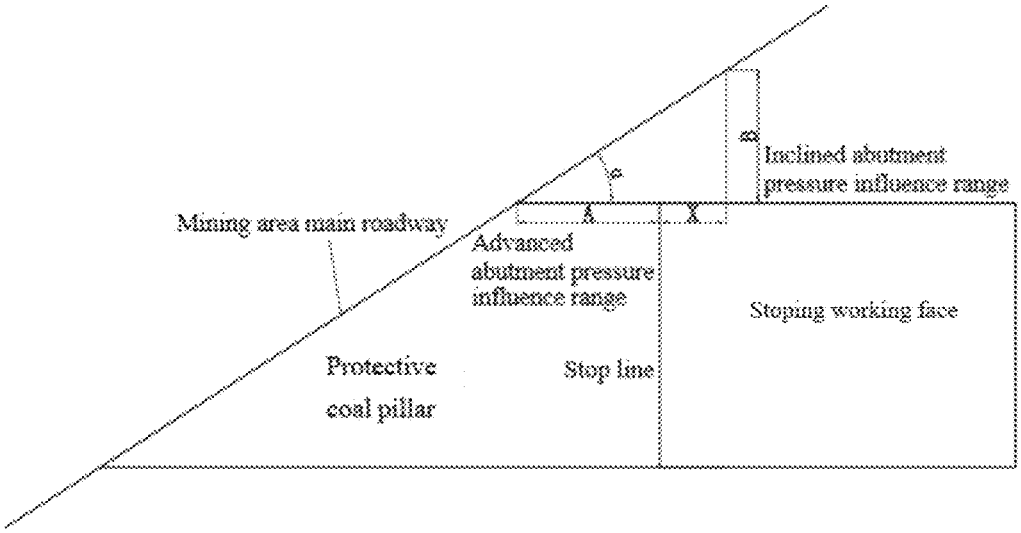
FIG. 9 is a schematic diagram of a geometric relationship between a working face and a mining area main roadway.

An angle between the mining area main roadway and the stoping direction of the working face is a, and the extension length of the slit to both ends is X m. The geometric relationship thereof is shown in FIG. 9. In practice, the applicant has found that the following geometric relationship should be satisfied in order to avoid the inclined abutment pressure acting on the main roadway:

$$(A+X)*\tan\alpha \geq B;$$

That is, $X \geq B/\tan\alpha - A;$ wherein

X is the extension length of the pre-splitting slit along the first or second gateway, whose unit is m;

α is the angle between the mining area main roadway and the stoping direction of the working face, whose unit is °;

A is an influence range of advanced abutment pressure of the working face, which is usually 40 m to 60 m;

B is a range of the abutment pressure in the inclined direction of the working face, which is usually 15 m to 30 m;

In addition to satisfying the above relational expression, the extension of the pre-splitting slit to both ends should be beneficial to the full collapse of roof strata near the stop mining line. Combining with engineering experience and considering economic benefits, a selection and calculation method of the extension length X of the pre-splitting slit along the first gateway or the second gateway is finally determined as follows:

when $B/\tan\alpha - A \leq 10$ m, X=10 m is selected to ensure that the rock strata fully collapse;

when $10 < B/\tan\alpha - A \leq 15$ m, $X = B/\tan\alpha - A$;

when $B/\tan\alpha - A > 15$ m, during which costs of slitting are higher than allowable costs of the project, X=15 m is selected, the abutment pressure in the inclined direction is offset by measures such as reinforcing support.

The present disclosure provides a pressure relief technology and a support structure of surrounding rock of a mining area main roadway, which mainly comprises a shaped charge directional roof cutting and pressure relief technology, a roof constant resistance support structure and a roadway side support structure. Shaped energy directional roof cutting and pressure relief technology refers to that charging of a bidirectional tensile shaped charge device is used to carry out shaped charge blasting, so as to cut off the roof to achieve the purpose of roof cutting and pressure relief at the stop mining line; the surrounding rock support structure comprises a main roadway roof constant resistance support structure and a roadway side support structure, and the roof constant resistance support structure refers to that constant resistance support is carried out on the roof of the mining area main roadway to improve its dynamic pressure resistance.

The corresponding arrangement positions and connection relationships of structures not mentioned in the present disclosure and a mutual sequence and control parameters of steps not mentioned may refer to similar devices and methods in the prior art, and the connection relationship, operation and working principle of the structures not mentioned are known to one skilled in the art, and will not be described in detail here.

Part of the examples in the specification are described in a progressive manner, each mainly illustrating differences from other examples, and the same or similar parts between which can refer to each other.

The above are only specific embodiments of the present disclosure to enable one skilled in the art to understand or implement the disclosure. Various modifications to these examples will be obvious to one skilled in the art, and the general principles defined herein can be implemented in other examples without departing from the spirit or scope of the present disclosure. Therefore, the present disclosure will not be limited to the examples shown in the present disclosure, but should conform to the widest scope consistent with the principles and novel features of the present disclosure.

What is claimed is:

1. A surrounding rock stability control method adapted for a coal mining area main roadway, comprising the following steps:

reinforcing support on a roof and two sides of the mining area main roadway on a basis of an original support form;

digging a safety roadway along a stop mining line of a present working face required by coal mine design, and supporting the safety roadway, wherein a protective coal pillar is formed between the safety roadway and the mining area main roadway;

performing slitting blasting on the roof in the safety roadway, wherein blast holes are arranged on a roadway corner line on one side of the present working face to form a pre-splitting slit, and a latest time of completing construction of the pre-splitting slit is when a length of the present working face to be stopped is equal to a width of the protective coal pillar; and performing stoping at a next working face after completing coal mining at the present working face when stoping at the present working face advances to the safety roadway.

2. The surrounding rock stability control method adapted for a coal mining area main roadway of claim 1, wherein one end of the pre-splitting slit extends to a roadway corner line of a first gateway near a previous working face, another end of the pre-splitting slit extends to a roadway corner line of a second gateway near the next working face, and both ends of the pre-splitting slit extend along the roadway corner lines of the two gateways to a direction away from the safety roadway.

3. The surrounding rock stability control method adapted for a coal mining area main roadway of claim 2, wherein a length of the pre-splitting slit extends along the roadway corner line of the first gateway or the second gateway is 10 m to 15 m.

4. The surrounding rock stability control method adapted for a coal mining area main roadway of claim 1, wherein in a step of reinforcing support on the roof and two sides of the mining area main roadway, a constant resistance support structure is used for reinforcing support on the roof, and a grouting anchor cable is used for reinforcing support on the two sides.

5. The surrounding rock stability control method adapted for a coal mining area main roadway of claim 4, wherein substantially simultaneously with a stoping process of a working face, the grouting anchor cable is used to grout the roof and sides of the mining area main roadway with cracks, so as to improve strength of surrounding rock of the roof and sides.

6. The surrounding rock stability control method adapted for a coal mining area main roadway of claim 1, wherein in a step of performing slitting blasting on the roof in the safety roadway, the blast hole is designed to be 8000 mm to 1000 mm in depth and 42 mm in diameter, leans to the working face and has an angle of 10° to 20° with a plumb line, and spacing between blast holes is 400 mm to 700 mm.

7. The surrounding rock stability control method adapted for a coal mining area main roadway of claim 6, wherein in a step of performing slitting blasting on the roof in the safety roadway, a bidirectional tensile shaped charge device is used for shaped charge blasting, a shaped charge blasting tube is used for loading 3 #emulsion explosive, and decoupling deck charging is used for blasting to form the pre-splitting slit.

* * * * *